US005486281A

United States Patent [19]

Gruver et al.

[11] Patent Number: 5,486,281

[45] Date of Patent: Jan. 23, 1996

[54] METHOD FOR CBN TIPPING OF HPC INTEGRALLY BLADED ROTORS

[75] Inventors: Gary A. Gruver, South Windsor; Joseph J. Parkos, Jr., East Haddam; Robert G. Adinolfi, Manchester, all of Conn.

[73] Assignee: United Technologies Corporation, Hartford, Conn.

[21] Appl. No.: 138,530

[22] Filed: Oct. 15, 1993

[51] Int. Cl.[6] ..... C25D 5/02

[52] U.S. Cl. ..... 205/110; 205/122; 205/128; 205/136

[58] Field of Search ..... 205/109, 110, 205/122, 128, 136; 204/224 R, 297 R

[56] References Cited

U.S. PATENT DOCUMENTS

| | | | |
|---|---|---|---|
| 4,082,640 | 4/1978 | Haack | 204/279 |
| 4,155,721 | 5/1979 | Fletcher | 51/295 |
| 4,169,020 | 9/1979 | Stalker et al. | 204/16 |
| 4,608,128 | 8/1986 | Farmer et al. | 204/16 |
| 4,627,896 | 12/1986 | Nazmy et al. | 204/37.1 |
| 4,789,441 | 12/1988 | Foster et al. | 204/37.1 |
| 5,074,970 | 12/1991 | Routsis et al. | 205/122 |
| 5,076,897 | 12/1991 | Wride et al. | 205/110 |
| 5,312,540 | 5/1994 | Kurono et al. | 205/110 |

*Primary Examiner*—John Niebling
*Assistant Examiner*—William T. Leader

[57] ABSTRACT

The present invention relates to a method and apparatus for forming abrasive surfaces on the tips of a plurality of workpieces such as the tips of gas turbine airfoil blades. The method broadly comprises the steps of providing a mechanical masking device having a plurality of openings arranged around the circumference of the device, installing an array containing a plurality of workpieces to be coated within the mechanical masking device so that portions of the workpieces including the tips thereof extend through the openings, immersing the mechanical masking device with the installed array of workpieces in a tank containing a plating bath with a matrix material and an abrasive grit material in slurry form so that the workpieces lie in a substantially horizontal plane, and applying a current through the plating bath to form the abrasive surfaces on the tips of the workpieces. The mechanical masking device protects portions of the array from the coating operation. A barrier device is also used to confine the abrasive grit material within a desired space during the formation of the abrasive coating on the tip portions.

9 Claims, 5 Drawing Sheets

METHOD FOR CBN TIPPING OF HPC INTEGRALLY BLADED ROTORS

BACKGROUND OF THE INVENTION

The present invention relates to a method and apparatus for simultaneously forming abrasive surfaces on the tips of a plurality of workpieces and more particularly, to a method and apparatus for applying electroplated coatings with abrasive grits to gas turbine airfoil blade tips in an integrally bladed rotor configuration.

It is known to provide at the tip of a gas turbine blade a coating which comprises abrasive particles embedded in a matrix, the tip being intended to run against the surface of a shroud of a material which is softer than the abrasive particles. By this means, it is possible to produce, by the abrasive action of the particles on the shroud, a gap between the blade tip and the shroud which is very small, thus minimizing gas losses. U.S. Pat. Nos. 4,169,020, 4,232,995 and 4,227,703, all to Stalker et al., illustrate a turbine blade tip having a coating containing abrasive particles entrapped within a metal matrix. The abrasive tip portion is formed by depositing abrasive particles and a metal matrix concurrently on an inner tip portion of the turbine blade after the inner portion has been bonded to a projection body. This codeposition of matrix material and particles is accomplished electrolytically from an electrodeposition bath in which there are suspended abrasive particles formed from aluminum oxide, cubic boron nitride (CBN), or other abrasive carbides, oxides, silicides, or nitrides.

U.S. Pat. No. 4,608,128 to Farmer et al. illustrates a method for applying abrasive particles to an article surface which includes providing an electrically nonconductive tape and particle member for use in an electrodeposition type system. The tape includes pores large enough to allow passage of electrodeposition current and electrolyte solution but smaller than the size of the abrasive particles to be retained on the tape. The tape has a porous adhesive layer of relatively low tack level, the adhesive carrying the abrasive particles through a first or relatively weak bond. A metallic coating is electrodeposited through the pores of the tape and the adhesive onto the article surface and about the abrasive particles in contact with the surface. This bonds the abrasive particles to the article surface primarily through a second bond between the metallic coating and the abrasive particle which is stronger than the first, relatively weak bond. Thereafter, the tape and particle member is separated at the first bond from the abrasive particles bonded to the article surface.

U.S. Pat. No. 4,610,698 to Eaton et al. illustrates a process wherein a combination of sintering, plasma arc spraying, hot isostatic pressing and chemical milling is used to form an abrasive surface on a turbine blade. Alumina coated silicon carbide particulates are clad with nickel and sinter bonded to the surface of a superalloy turbine blade tip. An impermeable layer of plasma arc sprayed superalloy matrix is deposited over the particulates and then has its inherent voids eliminated by hot isostatic pressing. The abrasive material so formed on the surface is then machined to expose the particulates. Next a portion of the matrix is removed so that the machine particulates projected into space and are thus best enabled to interact with the abradable ceramic air seals in a gas turbine engine.

U.S. Pat. Nos. 4,818,833 to Formanack et al. and 4,851,188 to Schaefer et al. illustrate yet another method and apparatus for fabricating a turbine blade having a wear resistant layer sintered to the blade tip surface. The abrasive, wear resistant layer is applied to the tip surface of a superalloy gas turbine blade by a high temperature sintering operation which produces a high strength bond between the layer and the blade, minimizes gamma prime phase growth, and prevents recrystallization in the blade. An inductively heated graphite susceptor is used to heat the blade and a refractory metal shield is used to surround the airfoil and root portions of the blade while leaving the tip portion exposed to the heat source.

U.S. Pat. No. 4,884,820 to Jackson et al. relates to a wear resistant, abrasive laser-engraved ceramic or metallic carbide surface for rotary labyrinth seal members. The tip is provided with a ceramic or metallic coating bonded thereto. The surface of the coating has a plurality of laser-formed depressions and is used to provide a wear resistant, cutting surface capable of cutting into a second member.

U.S. Pat. No. 5,074,970 to Routsis et al. relates to a method for applying an abrasive layer to titanium alloy compressor airfoils. The method described in this patent includes the application of several layers of nickel, one of which includes abrasive particulates. More specifically, the method comprises the steps of applying a first nickel layer having a thickness of about 12 to 18 microns directly to the blade tip surface; applying a second nickel layer to the first nickel layer, the second layer being less than about 1 micron in thickness; electroplating a third nickel layer onto the second nickel layer, and while the third layer is being electroplated, submerging the blade tip in a slurry of plating solution and electrically nonconductive abrasive particulates disposed upon a membrane permeable to electric current and plating solution, wherein the particulates in the slurry are entrapped in the third layer by the continued electroplating of nickel; applying a fourth nickel layer onto the third nickel layer wherein the combined thickness of the third and fourth nickel layers is between about 50 and 95% of the average particulate dimension; and heat treating the plated component.

U.S. Pat. No. 5,076,897 to Wride et al. also relates to a method of producing a gas turbine blade having an abrasive tip. The method described in this patent comprises producing a binding coat on the tip of the blade body by electrodeposition, the binding coat comprising MCrAlY where M is one or more of iron, nickel and cobalt, anchoring coarse particles of an abrasive material to the binding coat by composite electrodeposition of the particles and an anchoring coat from a bath of plating solution having the abrasive particles suspended therein, and then plating an infill around the abrasive particles. The anchoring coat may be of cobalt, nickel or MCrAlY and preferably has a thickness less than 30 microns. The infill material may also be MCrAlY. Preferably, the deposition of the infill is accompanied by vibration of the blade in a direction which is substantially vertical and substantially along the axis of the blade.

While the foregoing methods lend themselves to the formation of abrasive tips on individual airfoil blades, there is a problem with adapting them to situations where a plurality of blades spaced around the periphery of an integrally bladed rotor configuration need to be coated. The method and apparatus of the present invention are intended to overcome this deficiency in the prior art processes.

SUMMARY OF THE INVENTION

Accordingly, it is an object of the present invention to provide an improved method and apparatus for forming an abrasive surface on the tips of workpieces such as turbine blades.

It is a further object of the present invention to provide a method and apparatus as above which readily lends itself to applying electroplated coatings containing abrasive grits to gas turbine airfoil blade tips in an integrally bladed rotor configuration.

It is yet a further object of the present invention to provide a method and apparatus as above which allows all blades on an integrally bladed rotor configuration to be tipped simultaneously and thereby savings in cost and time.

It is yet a further object of the present invention to provide an apparatus for applying electroplated coatings with abrasive grits to gas turbine airfoil blade tips which reduce the amount of grit material required.

Other objects and advantages of the present invention are described in the following description and drawings in which like reference numerals depict like elements.

In accordance with the present invention, a method for forming abrasive surfaces on the tips of a plurality of workpieces, such as gas turbine airfoil blade tips, is described. The method comprises the steps of: providing a mechanical masking device having a plurality of openings arranged around the circumference of the device; installing an array containing a plurality of workpieces to be coated within the mechanical masking device so that portions of the workpieces including the tips thereof extend through the openings, the workpieces each having a longitudinal axis; immersing the mechanical masking device with the installed array of workpieces in a tank containing a plating bath containing a matrix material and an abrasive grit material in slurry form so that the longitudinal axis of each workpiece is substantially parallel to a bottom surface of the tank and the workpieces themselves lie in a substantially horizontal plane; and applying a current through the solution to form the abrasive surfaces on the tips of the workpieces. Prior to immersing the masking device with the installed array of workpieces into the plating tank, a maskant may be applied to the workpieces to protect portions of the workpieces not to be coated. If necessary, the maskant may be removed from the tips so as to expose the tips. Additionally, the tips may be etched prior to the plating step. Prior to plating, a barrier device may be placed around the periphery of the workpiece array for reducing the amount of abrasive grit material which is placed in the solution containing the matrix material and for preventing the abrasive grit material from entering voids between adjacent workpieces. The barrier device and a screen in the tank define a channel in which the abrasive grit material in slurry form is received. The channel is filled with sufficient grit material to cover the tips of the workpieces. After the abrasive surface has been formed on the tips of the workpieces, the maskant may be stripped from the non-coated portions of the workpieces and the array of workpieces may be removed from the mechanical masking device for further processing such as a heat treatment to improve the bond strength of the matrix material and to relieve stress.

The apparatus used to perform the method of the present invention includes a mechanical masking device for protecting central portions of the array containing the workpieces to be coated from being coated and a barrier device for assisting in confining the abrasive grit material within a desired space during the coating forming operation. The mechanical masking device in a preferred embodiment has a lower clamshell portion and an upper clamshell portion which together define an internal space for receiving portions of the array to be protected during the plating and/or coating operation. The mechanical masking device has a plurality of openings about its periphery through which portions of the workpieces to be coated extend. Additionally, the mechanical masking device has means for allowing it to be lifted into and out of tanks containing various solutions and at least one access port for allowing electrical leads and the like to be introduced into the internal space. The mechanical masking device is specifically designed to allow the workpieces to be coated, such as airfoil blades, to be positioned in a substantially horizontal plane during the formation of the abrasive tips.

The barrier device used to confine the abrasive grit material to a specific area preferably comprises baffle means surrounding the tip of the workpieces so as to prevent the grit material from entering voids between adjacent ones of the workpieces. The baffle means cooperates with a containment screen spaced from the tip portions of the workpieces to form a channel for the abrasive grit material. Preferably, the baffle means is formed by a solid material.

Other details of the method and apparatus of the present invention are set out in the following description and drawings.

DETAILED DESCRIPTION OF THE PREFERRED EMBODIMENT(S)

As previously discussed, the present invention relates to a method and apparatus for applying electroplated coatings with abrasive grits to workpieces such as gas turbine airfoil blade tips. The method and apparatus of the present invention have particular utility in applying a coating to the tips of airfoil blades in an integrally bladed rotor (IBR) array.

Figure 1:
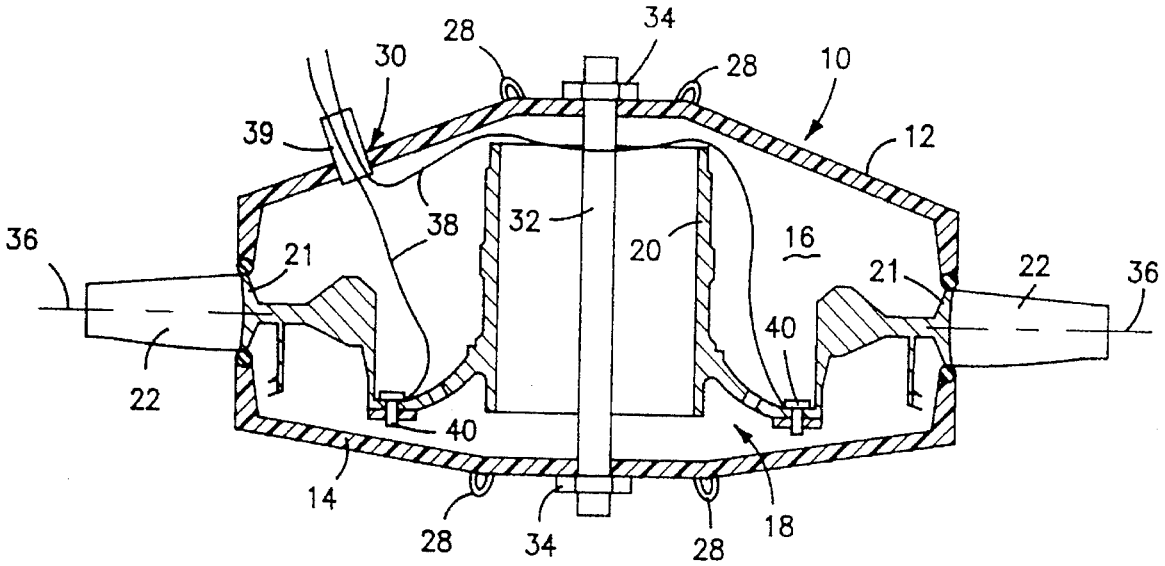
FIG. 1 is a sectional view of the mechanical masking device of the present invention having an integrally bladed rotor array installed therein.
Figure 2:
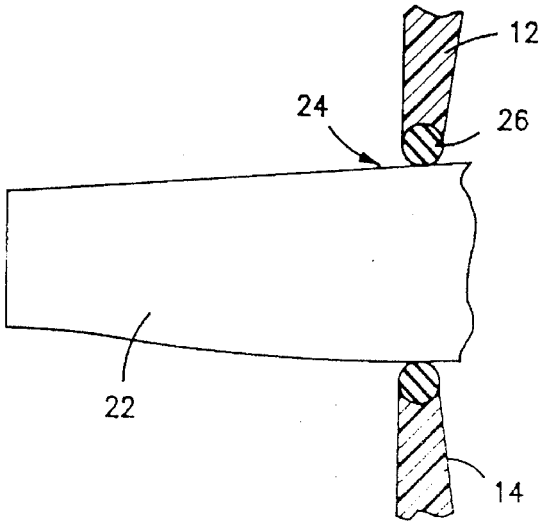
FIG. 2 is an enlarged view of one of the openings in the device of FIG. 1.
Figure 3:
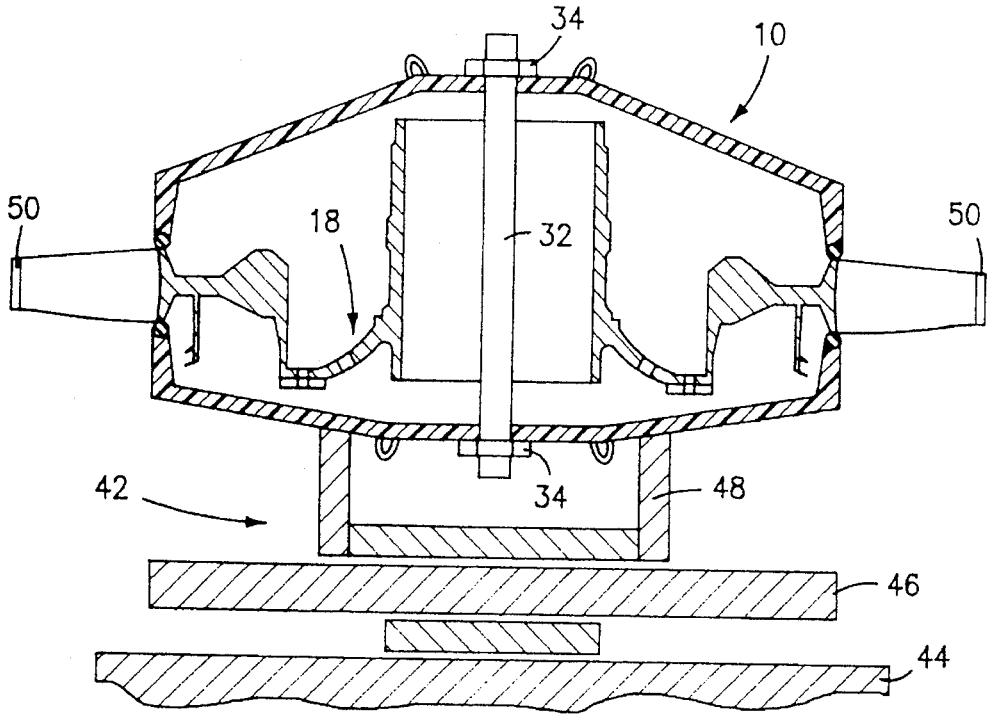
FIG. 3 is a sectional view of the mechanical masking device of FIG. 1 mounted on a support assembly.
Figure 5:
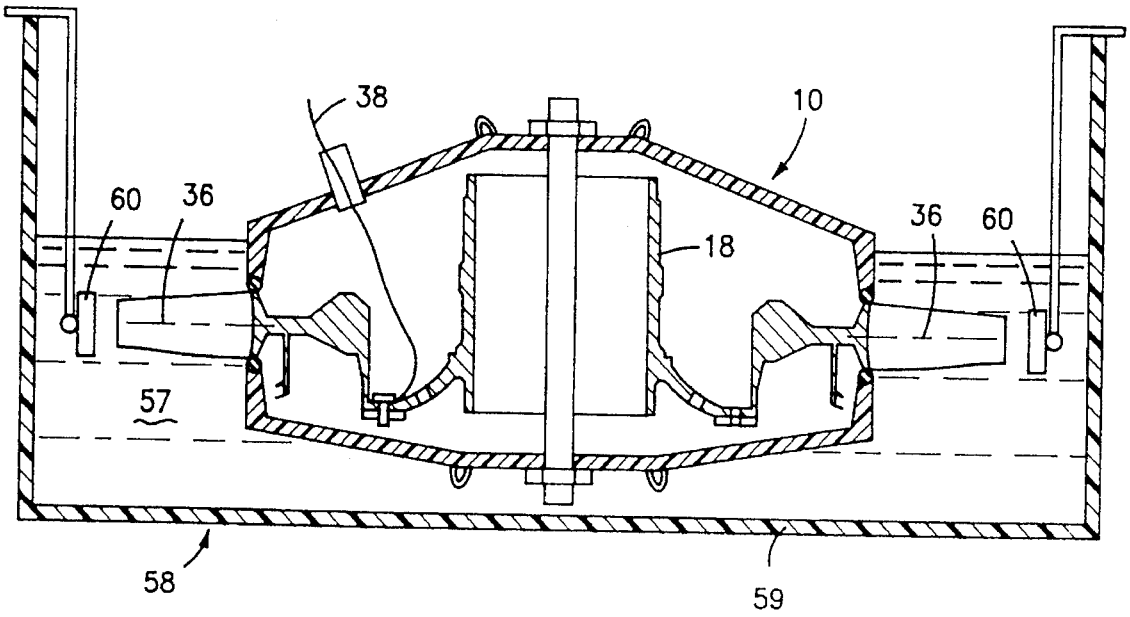
FIG. 5 is a sectional view of the mechanical masking device of FIG. 1 immersed within a tank containing a plating solution.
Figure 6:
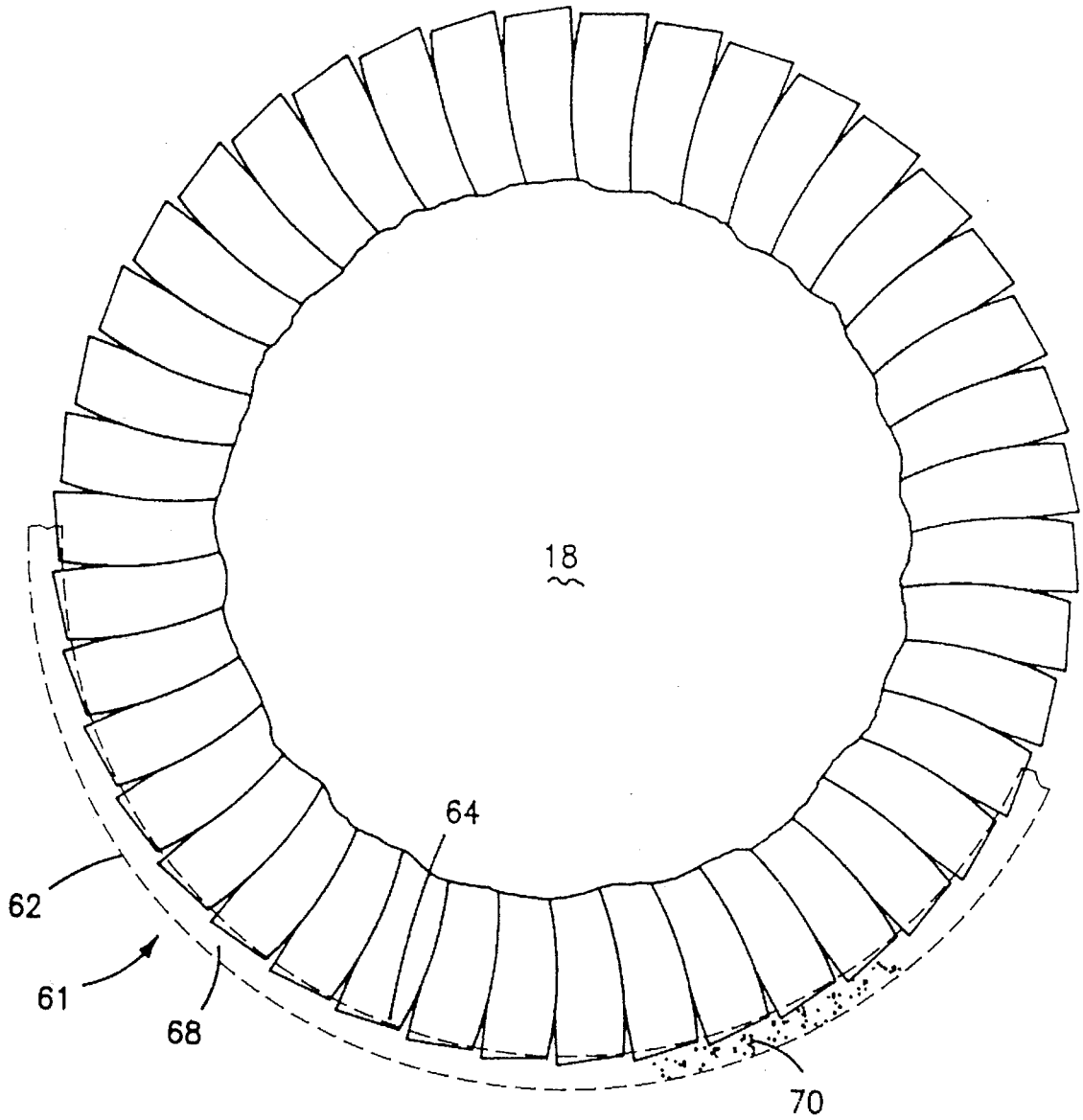
FIG. 6 is a top view of an integrally bladed rotor array having a grit barrier device affixed thereto.

Referring now to the drawings, FIG. 1 illustrates a mechanical masking device (10) for protecting portions of an integrally bladed rotor array (18) such as the disc structure (20) and loot portions (21) of airfoil blades (22) from the application of a coating. Typically, an integrally bladed rotor array has a central disc structure (20) and from 42 to 110 airfoil blades integrally joined to the disc structure. The blades (22), as shown in FIG. 6, are spaced around the disc structure and are typically formed from a nickel-based or titanium-based alloy.

The mechanical masking device (10) has an upper clamshell portion (12) and a lower clamshell portion (14) which when joined together define an internal space (16) and a plurality of openings (24) spaced about the circumference of the mechanical masking device. The number of openings (24) equals the number of blades (22) in the array (18). The upper and lower clamshell portions (12 and 14) may be formed from any conventional material known in the art which is resistant to the various solutions in which the mechanical masking device will be immersed. Preferably, the upper and lower portions are formed from a plastic material such as a plastic high pressure rigid laminate of continuous filament woven glass fabric impregnated with epoxy resin. As shown in FIG. 1, the upper and lower portions are joined together by a central rod (32) having threaded end portions (33) and nuts (34). The rod with the threaded end portions passes through the disc structure (20) and through openings (35) in the upper and lower clamshell portions. It is secured in place by the nuts (34) which have threaded portions which engage the threaded portions on the rod.

The upper and lower clamshell portions (12 and 14) are each provided with lift rings (28). The lift rings permit the mechanical masking device (10) with the integrally bladed rotor array (18) installed within the internal space (16) to be lifted in and out of tanks containing a variety of different solutions.

The upper clamshell portion (12) is also provided with at least one access port (30) through which electrical conductors (38) may be inserted into the space (16). The electrical conductors (38) may be connected to various portions of the integrally bladed rotor array by bolts (40) inserted into apertures in the array (18). This arrangement allows the array (18) to be used as a cathode during etching and plating operations.

As shown in the Figures, individual airfoil blades (22) extend through a series of openings (24). An O-ring (26) is preferably placed around the periphery of each of the openings (24) to prevent unwanted solutions from entering the space (16). The O-rings may be formed from any suitable plastic or rubber-like material known in the art.

In performing the method of the present invention, the integrally bladed rotor array is placed within the mechanical masking device (10) so that the disc portion (20) resides within the internal space (16) defined by the upper and lower clamshell portions while portions of the airfoil blades of the rotor array extend through the openings (24) spaced about the periphery of the device (10). As shown in FIG. 1, when correctly seated, the root portions (21) of the blades (22) abut the inside edge of the openings (24). As previously discussed, an O-ring (26) is placed about the periphery of each opening (24) to seal the opening and to prevent the ingress of undesired solutions.

Prior to placing the rotor array (18) in the masking device (10), the array may be cleaned using any standard technique known in the art.

After the rotor array (18) has been placed in the masking device (10) and the clamshell portions (12 and 14) have been joined together by the rod (32) and the nuts (34), the internal space (16) is preferably pressurized with helium or another inert gas to a pressure of about four pounds per square inch. Any suitable means known in the art may be used to introduce the helium into the internal space (16). For example, an access port (30) could be used to introduce the helium into the internal space. The helium is used to check the area around the openings (24) for leaks. Any electrical connections which are to be made to the internally bladed rotor array (18) are generally made prior to the introduction of the helium or other inert gas into the space (16). As shown in FIG. 1, the electrical conductors (38) may be protected by sealing device (39). The sealing device is preferably formed from a plastic material and also serves to prevent maskant from coating the conductors (38).

After the integrally bladed rotor array (18) is mounted within the mechanical masking device, the device (10) is lifted via the lift rings (28) and a hoist (not shown) onto a support assembly (42). The support assembly may be mounted to a bench (44) and be configured so as to permit the mechanical masking device (10) and the integrally bladed rotor array therein to be manually rotated. To permit this, the support structure preferably includes a lazy Susan-type table (46) having a 360° rotation capability. Additionally, the support assembly preferably includes a substantially U-shaped support structure (48) upon which the mechanical masking device (10) can be seated. The bench (44), the lazy Susan arrangement (46) and the support (48) may be formed from any suitable materials known in the art.

After the masking device (10) has been placed on the support assembly, the tip portions (50) of the airfoil blades (22) may be vapor honed on both sides of the tip to clean them. The vapor honing may be carried out using any suitable technique known in the art. For example, an operator may vapor hone both sides of the tips using a commercially available unit for applying a water and fine grit containing compound to the tip portions (50). After the vapor honing operation has been completed, the tips (50) may be rinsed using water or any other suitable liquid.

Figure 4:
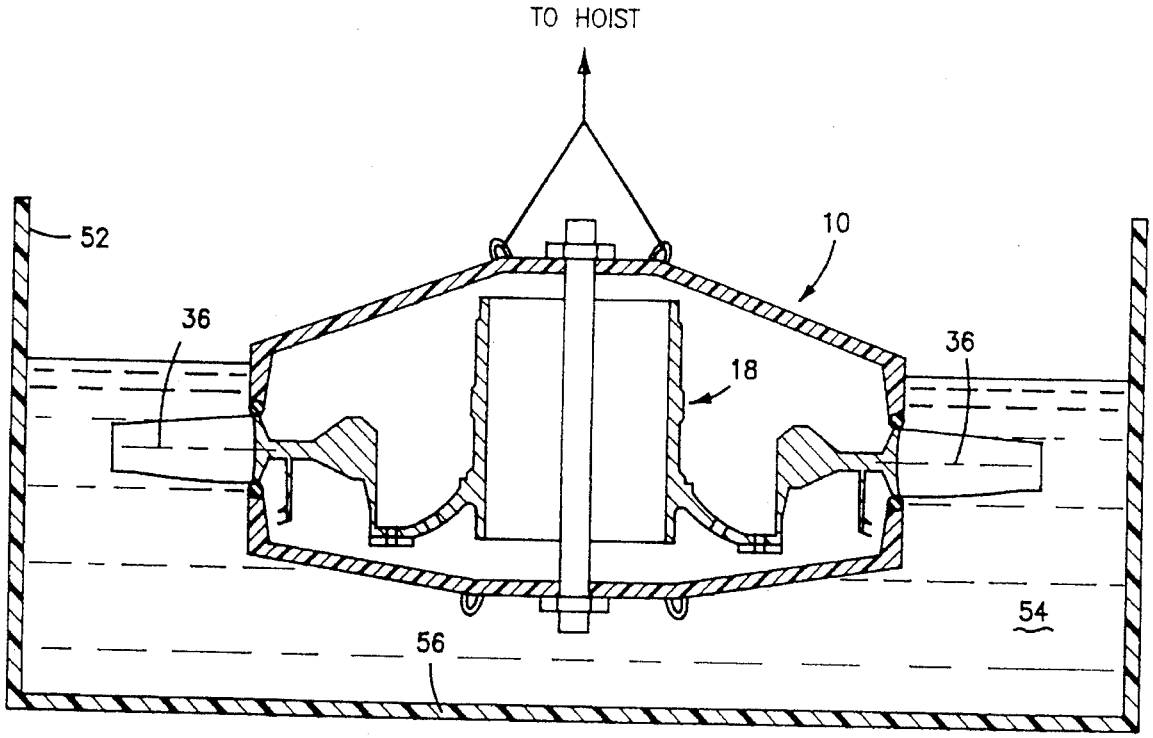
FIG. 4 is a sectional view of the mechanical masking device of FIG. 1 immersed within a tank containing a maskant solution.

Following the vapor honing, as shown in FIG. 4, the mechanical masking device with the integrally bladed rotor array mounted therein is at least partially immersed in a tank (52) containing a maskant solution (54). When the masking device is positioned within the tank (52), the integrally bladed rotor array is preferably maintained in a substantially horizontal plane so that the longitudinal axes (36) of all of the blades (22) are substantially parallel to a bottom surface (56) of the tank (52) and lie in a substantially horizontal plane.

The maskant solution (54) may comprise any suitable water- or solvent- based masking solution known in the art which when cured leaves a rubber-like protective coating or maskant (55) on the exposed portions of the airfoil blades (22). By at least partially immersing the mechanical masking device within the masking solution, the maskant will also seal portions of the device (10) including areas surrounding the access port(s) (30). If there are any electrical conductors connected to the integrally bladed rotor array, then these electrical conductors must be protected during this masking step.

If desired, the maskant may be applied to the blades (22) by immersing the mechanical masking device (10) with the assembly (18) therein in the masking solution (54), raising the mechanical masking device and the integrally bladed rotor out of the masking solution and allowing the device and the blades to drain while the rotor array is in a substantially horizontal position, followed by drying in the horizontal position. The mechanical masking device may then be inverted and the steps of dipping, draining and drying may be performed again. By inverting the mechanical masking device in this manner and dipping it a second time, one is able to obtain substantially equal maskant coverage on the leading and trailing edges of the airfoil blades.

If desired, the mechanical masking device with the integrally bladed rotor array installed therein may be inserted into an oven (not shown) to effect drying between the two dipping steps. Additionally, the device (10) and the rotor array mounted therein may also be placed in the oven after the final dipping step.

Optionally, prior to the immersion of the mechanical masking device in the masking solution, maskant material may be applied manually over the O-rings (26) surrounding the openings (24).

After the final dipping and drying steps, the mechanical masking device with the integrally bladed rotor array installed therein is returned to the support assembly (42). There, the operator removes the maskant from the tip portions (50) of the airfoil blades (22). This is preferably done manually with the help of a razor blade. If the operator removes too much maskant from the tip portions (50), repair can be effected by using a dilute masking solution followed by drying and a recut of the repaired tip portion (50).

Following the exposure step, the tip portions (50) are vapor blasted to clean them. This may be done using a commerically available unit for blasting the tip portions with a fine grit of alumina or silicon carbide. After vapor blasting, the tip portions may be degreased and cleaned in preparation for the plating operation.

As a precursor to the plating operation, the tip portions (50) are preferably etched. This may be done using any suitable etching technique known in the art. Preferably, the etching operation is performed by first dipping the mechanical masking device (10) with the rotor array installed therein in a first tank containing an etching solution; removing the mechanical masking device and the rotor array from the first tank; and then immersing the mechanical masking device and the rotor array in a second tank such as tank (58) and performing an anodic etching operation. The etchant solution in the first tank may comprise a HCl-HF acid dip. The device (10) and the array (18) may be immersed in this etchant solution for 15 to 20 seconds. The etchant used in the anodic etching operation may comprise an acetic acid-hydrogen fluoride etching solution. The anodic etching operation may be performed using any conventional technique known in the art. For example, an anode (60) may be immersed in the tank (58) containing the etchant and electrical conductor(s) (38) connected to flange portions of the rotor array (18) may be connected to a power source (not shown) for applying a current so that the rotor array (18) acts as the cathode. The etching may be carried out at 15 ASF for up to 6 minutes. A rinse in cold water may be effected between the two etching steps and after the final etching step.

Figure 7:
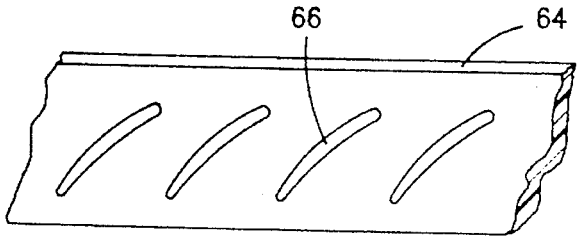
FIG. 7 is a side view of a portion of the grit barrier device of FIG. 6.

After the etching operation has been completed, the mechanical masking device (10) and the rotor array (18) are removed from the tank (58) for installation of a grit containment or barrier device (64). The grit containment device as shown in FIGS. 6 and 7 comprises a substantially solid barrier member mounted to tip portions of the airfoil blades (22). The barrier member (64) has a plurality of slots (66) through which the tip portions (50) can be inserted. Preferably, the barrier member (64) has slots (66) equal in number to the number of blades (22). The barrier member when installed fits around the tip portions (50) and preferably is substantially flush with the tip portions (50). The member (64) is solid except for the slots (66) in order to prevent abrasive grit material from entering into voids between adjacent one of the blades (22) and to fill gaps between the workpieces. The barrier member (64) may be formed from a plastic material such as polypropylene.

The barrier member (64) is designed to mate with a substantially circular containment screen (62) positioned within the plating tank (72). As shown in the drawings the screen (62) surrounds and is spaced from the periphery of the blade assembly defined by the tip portions (50). The barrier member (64) and the screen (62) together form a channel (68) in which abrasive grit material (70) in slurry form is introduced. Preferably, the channel (68) has a width of about ½ inch. The material forming the screen (62) may comprise any suitable material known in the art which is impervious to the plating bath and should have openings sufficiently sized to allow plating solution to flow into the channel (68) without the grit material falling out.

Figure 8:
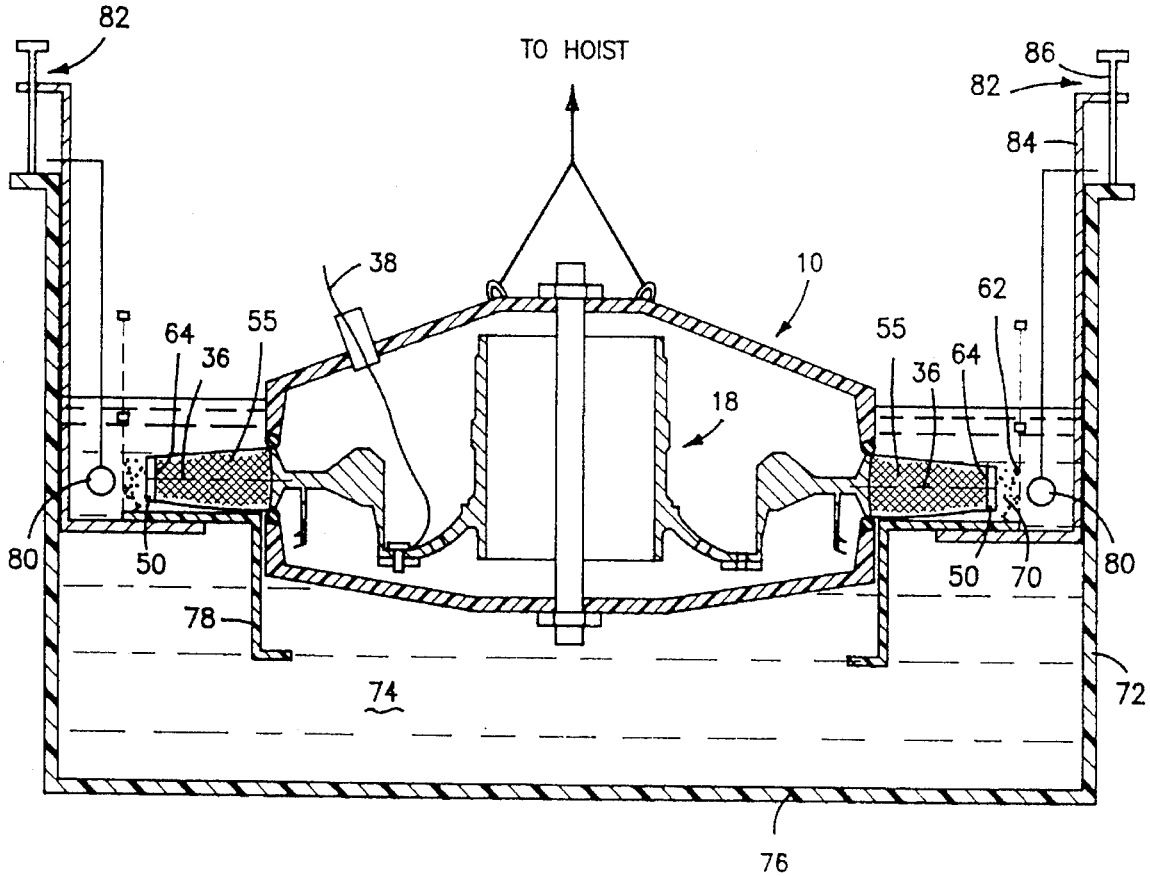
FIG. 8 is a sectional view of the mechanical masking device of FIG. 1 with the barrier device of FIG. 6 immersed in a plating solution.

After the grit containment device (64) has been installed, the mechanical masking device (10) and the rotor array (18) with the grit device (64) in place is lowered into the tank (72) which contains the screen (62) and a plating solution (74). As shown in FIG. 8, the device (10) is inserted into the tank (72) so that the airfoil blades (22) lie in a substantially horizontal plane with the longitudinal axes of the blades (22) lying in a substantially horizontal plane which is also substantially parallel to bottom surfaces (76) of the tank (72). The tip portions (50) of the blades (22) are each preferably oriented in a substantially vertical plane during plating. As shown in FIG. 8, the mechanical masking device preferably rests on a support structure (78).

The plating solution (74) contains a matrix material such as nickel or cobalt to be plated onto the tip portions (50) as both a bond coat and an overcoat. In a preferred embodiment of the present invention, the plating solution comprises a standard nickel sulfamate plating bath.

After the mechanical masking device is placed in the tank (72), an electric current of 30 ASF is applied to the solution (74) for about 10 minutes via anodes (80) and cathodes (18). This causes a light layer of the matrix material to bond to the tip portions. Thereafter, the current is lowered so as to continue light plating of the matrix material and abrasive grit material, preferably in slurry form, is placed within the channel (68). The abrasive grit material preferably comprises cubic boron nitride particles having a mesh size of from about 100 to about 120 mesh.

Thereafter, the current is raised to 20 ASF for 30 to 35 minutes and applied through the plating solution via the anodes (80) and the integrally bladed rotor array which is electrically connected by electrical conductor(s) (38) to a current source (not shown) so that the rotor array acts as a cathode. The abrasive grit material which is introduced into the channel (68) should be present in an amount sufficient to cover the tips (50) of the blades (22) throughout the plating operation. By plating in this manner, a matrix material such as nickel and an abrasive grit material such as the cubic boron nitride particles are codeposited onto the tip portions (50) of the blades (22) with the nickel acting as an overcoat.

After the co-deposition operation is completed, the current is lowered to a level which allows a further overplate of the matrix material. Thereafter, the mechanical masking device (10) with the rotor array (18) is removed from the tank. In addition to a hoist (not shown) connected to the lift rings (28), jack screws (82) may be provided to help position the mechanical masking device (10) within the tank and assist in lifting the device out of the tank. The jack screws (82) may comprise any suitable jack screw arrangement known in the art. For example, as shown in FIG. 8, the jack screw arrangement may include a support structure (84) and a screw arrangement (86) for raising and lowering the support structure (84).

Following the plating operation, the grit containment device (64) is removed. If desired, the tip portions (50) of the blade assembly (18) may be subjected to yet another overplating operation in which the mechanical masking device with the integrally bladed rotor array is again placed in a plating tank such as tank (72) containing a fresh supply of plating bath (74), one without grit particles therein. Electrical current may be applied for 80 to 85 minutes to form this overplate of the matrix material.

Following the final plating step, the tip portions may be rinsed with water for approximately 3 minutes. Thereafter, the tips of the blades may be visually inspected for uniform grit distribution. If satisfactory uniform grit distribution is present, the masking material surrounding the blades (22) may be removed by cutting the trailing edge with a razor blade and peeling back the remainder of the maskant using a wooden stick. Following the removal of the masking material, visual inspection may again be carried out to insure uniform grit distribution.

The rotor blade assembly (18) may then be removed from the mechanical masking device (10) by separating the upper and lower clamshell portions (12 and 14). Thereafter, the rotor array (18) may be subjected to a heat treatment to improve the bond strength of the matrix material and for stress relief. This heat treatment may be carried out at a temperature of 700° F., plus or minus 25° F. for one hour in any suitable heat treating facility known in the art. Thereafter, a final inspection of the tip portions may be carried out. If desired, tests may be performed to test the strength of the bond.

While the plating operation has been described as including the installation of a grit containment device (64) and insertion of an abrasive grit material into a channel formed by the grit containment device and a fixed screen, it should be recognized that the plating operation could also be carried out without the grit containment device. For example, abrasive grit particles could be placed into the plating solution (74) and be allowed to become bonded to the tip portions (50) along with the matrix material by applying current through the plating solution in the manner previously described.

While the present invention has been described in the context of forming an abrasive surface on the tip of a airfoil blade, it should be recognized that the method and apparatus of the present invention be used in other contexts. For example, the method and apparatus of the present invention could be used on other workpieces besides an array of airfoil blades. They could be used on an array of knife edge seals if so desired.

The method and apparatus of the present invention provide many advantages. For example, they allow a plurality of workpieces, as many as 110, to be provided with abrasive surfaces at a single time. Furthermore, the method and apparatus of the present invention are easy to use since once the rotor array (18) is placed in the masking device (10), it does not have to be removed until the final plating operation has been completed. This results in effective cost and time savings. The use of the grit containment device is advantageous in that it reduces the amount of grit material which is generally used in this type of operation. It is also believed that the method of the present invention yields optimum fatigue strength on the workpieces and significantly reduces the risk of etching and plating solutions adversely affecting the strength of the individual rotor blades and the overall rotor array.

Still further, the method of the present invention allows an operator to chamfer the airfoil blades (22) prior to the plating operation if desired. This chamfering of the blades may be carried out in any suitable manner known in the art.

It is apparent that there has been provided in accordance with this invention a method and apparatus for abrasive tipping of integrally bladed rotors which fully satisfy the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A method for forming abrasive surfaces on the tips of a plurality of airfoils integrally joined to a disc structure, said method comprising the steps of:

providing a mechanical masking device having a plurality of openings arranged around the circumference thereof;

installing said airfoils and disk structure within said mechanical masking device so that said disk structure is protected by said masking device and portions of said airfoils including tip portions thereof extend through said openings;

forming a coating containing abrasive particles on said tip portions of said airfoils;

said forming step comprising immersing said mechanical masking device with said installed airfoils in a plating solution containing a matrix material and an abrasive grit material, said airfoils lying in a substantially horizontal plane and said tip portions each being oriented in a substantially vertical plane during the coating forming step; and said forming step further comprising applying an electrical current through said plating solution so as to cause said matrix material and said grit material to be deposited onto said tip portions.

2. The method of claim 1 further comprising:

applying a maskant to said airfoils prior to said forming step;

exposing the tip portions of said airfoils after said maskant applying step; and etching said tip portions prior to said forming step.

3. The method of claim 1 wherein said immersing step comprises immersing said airfoils in a plating solution containing a nickel matrix material and a cubic boron nitride grit material.

4. The method of claim 1 further comprising: overplating said deposited grit material with a layer of matrix material.

5. The method of claim 1 further comprising:

placing a barrier device for containing said grit material about said tip portions of said airfoils;

providing said tank with a substantially circular screen; and filling a channel formed by said screen and said barrier device with said grit material to a level where said tip portions are completely covered by said grit material.

6. A method for forming abrasive surfaces on the tips of a plurality of workpieces, said method comprising the steps of:

providing a mechanical masking device having a plurality of openings arranged around the periphery of said device;

installing an array containing said plurality of workpieces within said mechanical masking device so that portions of said workpieces including tip portions thereof extend through said openings, said workpieces each having a longitudinal axis;

applying a maskant to said workpiece portions;

removing said maskant from said tip portions so as to expose said tip portions;

placing a barrier device about a periphery of said workpiece array defined by said tip portions, said barrier device assisting in reducing the amount of an abrasive grit material which is used during formation of said abrasive surfaces and preventing the grit material from entering wilds between said workpieces;

immersing said mechanical masking device with said installed array of workpieces in a tank containing a plating solution containing a matrix material and the abrasive grit material with the longitudinal axes of the workpieces being substantially parallel to a bottom surface of the tank, said barrier device mating with a screen in said tank to form a channel for receiving said grit material;

filling said channel with sufficient grit material to cover the tip portions of said workpieces; and applying a current through said plating solution to form said abrasive surfaces on the tips of said workpieces.

7. The method of claim 6 further comprising:

plating a layer of matrix material over said abrasive grit material.

8. The method of claim 6 further comprising:

stripping said maskant from non-exposed portions of said workpieces; and removing said array from said mechanical masking device.

9. The method of claim 8 further comprising:

heat treating said workpieces having said abrasive surfaces on said tip portions so as to improve the bond strength of the matrix material and to relieve stress.

* * * * *